US007617863B2

(12) United States Patent
Yu et al.

(10) Patent No.: US 7,617,863 B2
(45) Date of Patent: Nov. 17, 2009

(54) METHOD AND APPARATUS FOR TEMPERATURE CONTROL IN A CONTINUOUS CASTING FURNACE

(75) Inventors: Kuang-O Yu, Highland Heights, OH (US); Frank P. Spadafora, Niles, OH (US); Michael P. Jacques, Canton, OH (US)

(73) Assignee: RTI International Metals, Inc., Niles, OH (US)

( * ) Notice: Subject to any disclaimer, the term of this patent is extended or adjusted under 35 U.S.C. 154(b) by 0 days.

(21) Appl. No.: 11/503,440

(22) Filed: Aug. 11, 2006

(65) Prior Publication Data

US 2008/0035298 A1 Feb. 14, 2008

(51) Int. Cl.
*B22D 11/16* (2006.01)
*B22D 11/20* (2006.01)
*B22D 11/22* (2006.01)

(52) U.S. Cl. ..... 164/452; 164/454; 164/455; 164/475; 164/154.1; 164/154.7; 164/415

(58) Field of Classification Search ..... 164/452, 164/454, 443, 513, 154.1, 154.6, 155.7, 415, 164/475, 455, 154.7
See application file for complete search history.

(56) References Cited

U.S. PATENT DOCUMENTS

| | | | | |
|---|---|---|---|---|
| 2,799,065 | A * | 7/1957 | Whitaker | 164/475 |
| 2,882,570 | A * | 4/1959 | Brennan et al. | 164/474 |
| 3,800,848 | A * | 4/1974 | Chaulet et al. | 164/453 |
| 4,756,357 | A * | 7/1988 | Banninger et al. | 164/455 |
| 6,793,005 | B2 * | 9/2004 | Lee et al. | 164/415 |

FOREIGN PATENT DOCUMENTS

JP 9-271918 A * 10/1997

* cited by examiner

*Primary Examiner*—Kevin P Kerns
(74) *Attorney, Agent, or Firm*—Sand & Sebolt

(57) ABSTRACT

A continuous casting furnace includes a temperature control mechanism for controlling the temperature of a metal casting as it exits a continuous casting mold in order to provide improved characteristics of the metal casting. The temperature control mechanism includes a temperature sensor for sensing the temperature of the metal casting, and a heat source and cooling device for respectively heating and cooling the metal casting in light of the temperature of the metal casting. A control unit determines if the temperature of the metal casting is within a predetermined range and controls the heat source and cooling device accordingly. The heat source may double as a cooling device or the cooling device may be separate from the heat source.

24 Claims, 2 Drawing Sheets

METHOD AND APPARATUS FOR TEMPERATURE CONTROL IN A CONTINUOUS CASTING FURNACE

BACKGROUND OF THE INVENTION

1. Technical Field

The present invention relates generally to continuous casting furnaces. More particularly, the invention relates to a continuous casting furnace having a temperature control for controlling the temperature of the metal casting produced via a continuous casting mold of the furnace. Specifically, the invention relates to such a temperature control which includes a temperature sensor, a heating source and a cooling source for controlling the temperature of the metal casting in order to provide improved characteristics of the casting.

2. Background Information

The principal of continuous casting is to pour molten metal into a water-cooled copper mold and continuously withdraw the solidified metal out of the mold to form a cast ingot/bloom/billet/slab. The continuous casting process is widely used for making steel casts, the direct chill casting (DC casting) process for making aluminum, copper and nickel base alloys, and the electroslag remelting (ESR) process for making nickel base superalloys, tool steels and stainless steels. The cast bloom/billet/slab during the continuous casting of steel can be cut in specified lengths and removed. Thus, the casting process can, in theory, continue indefinitely. On the other hand, DC casting and ESR processes are used to cast a finite length of ingot/billet/slab. Thus, they are commonly referred to as semi-continuous casting processes.

For both the continuous casting of steel and semi-continuous casting of non-ferrous alloys, the temperature control of the cast ingot/billet/slab is a crucial factor to ensure a smooth operation of the casting process. Water spray is commonly used to speed up the heat removal of the metal casting, resulting in a fast cooling rate and a reduced degree of macrosegregation in the resultant ingot/billet/slab. For a moderate cooling effect, forced air cooling can be used. However, for the casting of segregation-prone and cracking-prone alloys such as tool steels, an insulation blanket is sometimes used to cover the surface of the cast ingot and slow down the ingot cooling rate. This results in a reduction in the temperature gradient, residual stress and cracking tendency in the cast ingot.

Plasma arc melting (PAM) and electron beam melting (EBM) are two semi-continuous casting processes commonly used to make titanium alloys and, to a less extent, nickel base superalloys. PAM is performed in an inert gas (Ar or He) environment whereas EBM is performed in an environment under vacuum. For both processes, the furnace chamber is sealed from outside air atmosphere. Thus, the methods of water spray and forced air cooling cannot be used in PAM and EBM for controlling the ingot temperature.

The current invention is an innovative method to control the temperature of a continuously cast ingot, certain aspects of which are particularly useful in an inert gas or vacuum environment. Such temperature control provides improved characteristics of the metal casting such as surface smoothness and internal metallurgical structure, which are strongly dependent on the temperature distribution within the ingot.

BRIEF SUMMARY OF THE INVENTION

The present invention provides an apparatus comprising a continuous casting mold adapted to produce a metal casting; a metal casting pathway which is disposed below the mold and adapted to allow the metal casting to move therethrough; and a temperature control mechanism including a portion which is disposed adjacent the pathway whereby the mechanism is adapted to control the temperature of the metal casting; wherein the temperature control mechanism includes a temperature sensor for sensing temperature at a location which is disposed on the pathway whereby the temperature sensor is adapted to measure the temperature of the metal casting at the location.

The present invention also provides a method comprising the steps of forming a metal casting with a continuous casting mold; sensing the temperature of the metal casting as it exits the mold; and controlling the temperature of the metal casting exiting the mold in response to the step of sensing.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
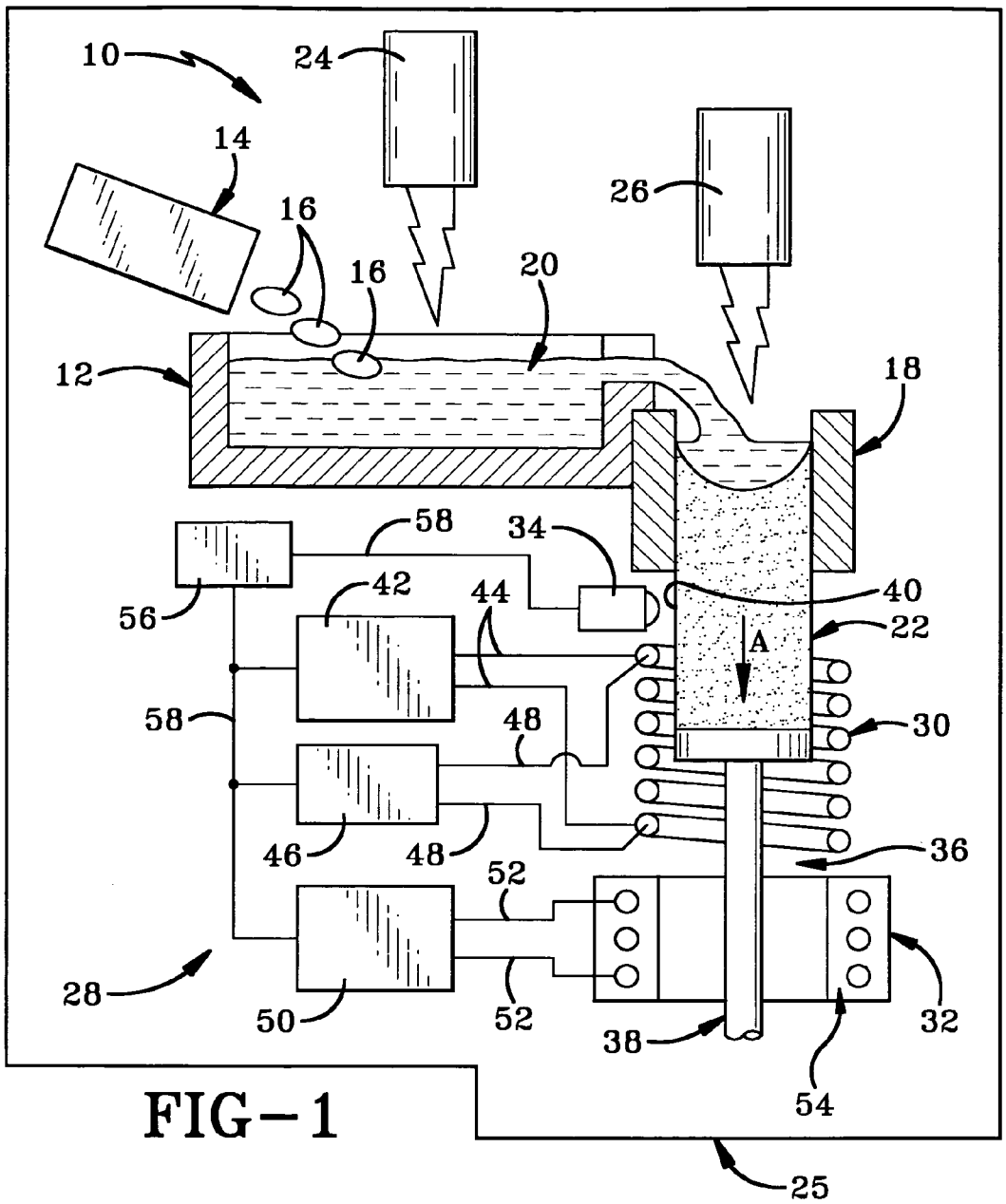
FIG. 1 is a diagrammatic elevational view of the continuous casting furnace and temperature control mechanism of the present invention and shows an early stage of the formation of a metal casting.
Figure 2:
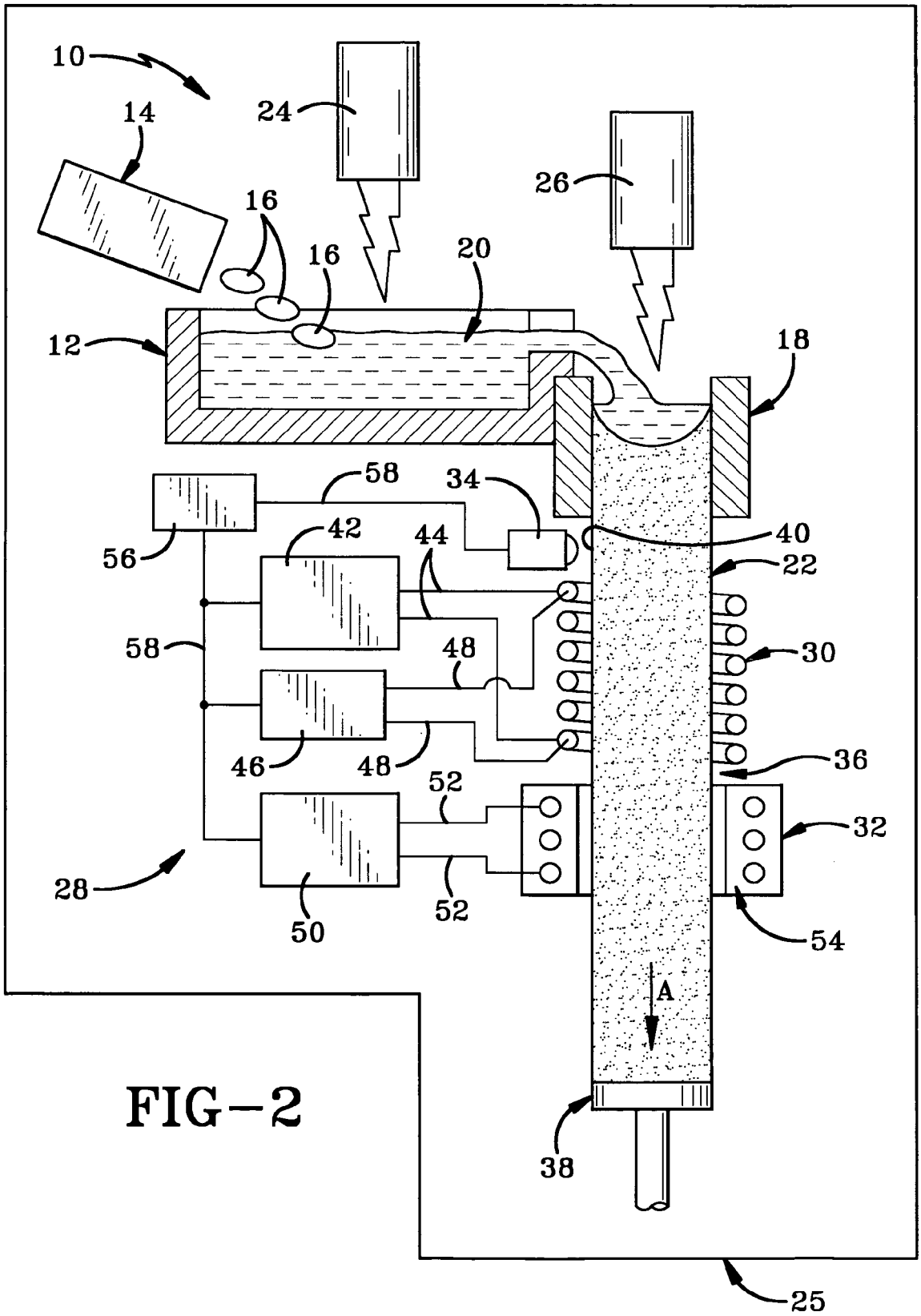
FIG. 2 is similar to FIG. 1 and shows a further stage of the formation of the metal casting.

The continuous casting furnace of the present invention is indicated generally at 10 and FIGS. 1 and 2. Furnace 10 includes a melting hearth 12 having a melting cavity and a feed mechanism 14 for feeding solid metal feed material 16 into the melting cavity of hearth 12. Furnace 10 further includes a continuous casting mold 18 situated for receiving molten material 20 from an overflow of melting hearth 12 in order to form a metal casting 22 therewith. First and second heat sources 24 and 26 are respectively positioned above melting hearth 12 and mold 18. First heat source 24 provides heat for melting material 16 to form molten material 20 and second heat source 26 provides heat for controlling the solidification rate of the material once it has entered mold 18. The above components are typically disposed within a melting chamber 25 which is sealed from the external environment. Chamber 25 may be filled with an inert gas such as argon or helium, as is used in plasma arc melting, or may be under vacuum, as is the case with the use of electron beam melting. Heat sources 24 and 26 are most typically plasma torches or electron beam guns although other heat sources known in the art may be used.

In accordance with a feature of the invention, furnace 10 includes a temperature control mechanism 28 for controlling the temperature of metal casting 22 as it exits mold 18 in order to provide the improved qualities as noted in the Background section of the present application. Mechanism 28 includes a third heat source in the form of an induction coil 30, a cooling device preferably in the form of an argon or helium cooling ring 32 and a temperature sensor 34. Induction coil 30 and cooling ring 32 are disposed adjacent a metal casting pathway 36 which extends downwardly from mold 18 and through which metal casting 22 passes as it exits mold 18. Preferably, each of induction coil 30 and cooling ring 32 circumscribe pathway 36 and thus circumscribe metal casting 22 as it passes there through as it is lowered at indicated at arrow A by a lift 38. Each of induction coil 30 and cooling ring 32 are disposed below mold 18. While ring 32 is shown below coil 30, these positions may be reversed if desired. Temperature sensor 34 is configured to measure or sense the temperature of metal casting 22 at a temperature measurement location 40 disposed on pathway 36. In particular, location 40 is disposed below mold 18 and above each of coil 30 and ring 32 although this may also vary. Sensor 34 is suitable for use in inert gas and vacuum environments or otherwise.

Mechanism 28 further includes an electric power source 42 which is in electrical communication with induction coil 30 via electrical conductors 44. In addition, coil 30 is typically a water cooled coil and is thus in communication with a source 46 of cooling water or other cooling liquid via conduits 48. Source 46 includes a pump for recirculating the liquid through coil 30, the pump having on and off positions and a rate control mechanism. Mechanism 28 further includes a source 50 of cooling gas which is in communication with cooling ring 32 via at least one conduit 52. Source 50 includes a gas flow control with on and off positions and a rate control mechanism. In one embodiment, a gas may be recirculated through ring 32 in a closed loop fashion. In an alternate embodiment, a cooling gas pathway 54 is in fluid communication with cooling device 32 and metal casting pathway 36 to allow the gas to flow from ring 32 to pathway 36. Mechanism 28 further includes a control unit 56 which is in communication with each of temperature sensor 34, electrical power source 42, source 46 of cooling liquid and source 50 of cooling gas, typically via electrical conductors 58.

The operation of temperature mechanism 28 is described with reference to FIGS. 1-2. As metal casting 22 is formed via mold 18 and is lowered by lift 38, temperature sensor 34 measures or senses the temperature of metal casting 22 along the outer surface thereof at location 40. A signal corresponding to the temperature is sent from sensor 34 via conductor 58 to control unit 56, which includes a logic circuit programmed to control operation of power source 42, source 46 of cooling liquid and source 50 of cooling gas as needed in order to adjust the temperature of metal casting 22 as it passes through coil 30 and ring 32. Control unit 56 compares the temperature sensed by sensor 34 with a predetermined value range of temperatures which is desired for metal casting 22 and controls mechanism 28 in accordance therewith.

Figure 3:
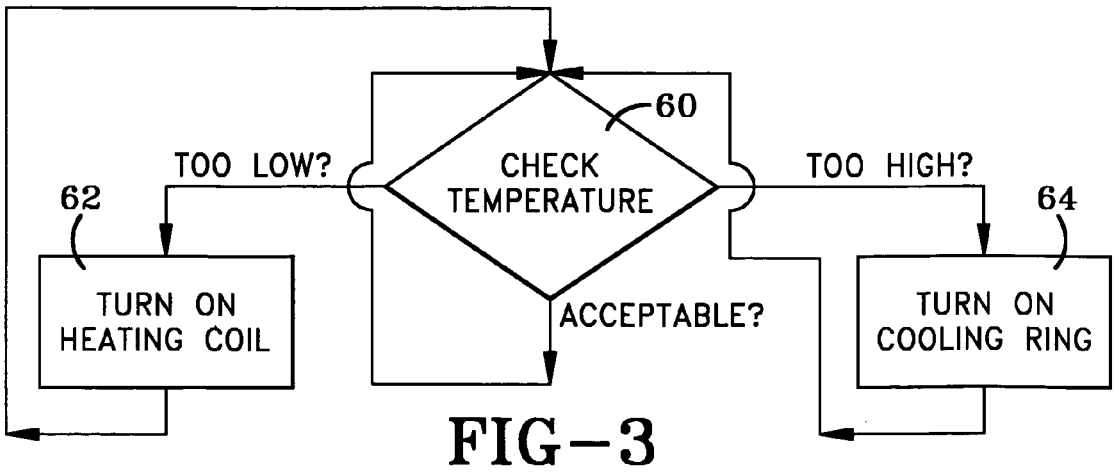
FIG. 3 is a flow chart showing the basic method of the present invention.

The basic process is indicated in FIG. 3. More particularly, sensor 34 checks the temperature of metal casting 22 as indicated at block 60, and as long as the temperature is within an acceptable range, sensor 34 continues to check the temperature without control unit 56 making any changes to adjust the temperature of metal casting 22. In the simplistic mode illustrated in FIG. 3, if the temperature is too low, control unit 56 turns on heating coil 30 in order to raise the temperature of metal casting 22 and if the temperature of metal casting 22 is too high, control unit 56 turns on cooling ring 32 to cool metal casting 22 as needed.

However, the process may be modified in a variety of ways in order to control the temperature of metal casting 22 as it moves downwardly as indicated in FIGS. 1 and 2. For instance, if the temperature of metal casting 22 sensed by sensor 34 is too low, the heat source such as induction coil 30 may be turned on as previously indicated or the power to the heat source may be increased if it is already on in order to increase the temperature. If the temperature of the metal casting sensed is too high, heating coil 30 or another heat source may either be turned off or the heat output thereof may be reduced, which in the present embodiment would involve reduction of the power to coil 30 provided by source 42. In short, coil 30 may be operated to raise the temperature of metal casting 22 or may be operated to reduce the amount of heat output to effectively lower the temperature of metal casting 22. In addition, coil 30 may be configured to double as a cooling device. For example, source 46 of cooling liquid may be operated to move cooling liquid via conduit 48 through the tubular structure of coil 30, as is commonly used with water cooled induction coils. Of course coil 30 may also be a resistively heated element which may also involve the use of a tubular coil which allows for the circulation of the cooling liquid via source 46. Thus, if the temperature of metal casting 22 is too high, coil 30 may be operated in its cooling mode via the circulation of cooling liquid there through in order to cool metal casting 22.

Alternately or in conjunction therewith, control unit 56 may operate source 50 of cooling gas to circulate said gas through cooling ring 32 in order to provide cooling effects to metal casting 22 as it passes there through, as shown in FIG. 2. Cooling ring 32 may be configured to simply re-circulate the gas from source 50 in a closed loop or may be configured to allow the gas to move out of ring 32 through cooling gas pathway 54 toward metal casting 22 as casting 22 passes by ring 32 in order to provide a more direct cooling effect by bringing the cooling gas into contact with or closely adjacent metal casting 22. When furnace 10 is operated within a sealed chamber filled with an inert gas such as argon or helium, the latter configuration is preferred, and source 50 may simply be the gas within chamber 25. Thus, helium gas or another appropriate inert gas may be used as the cooling gas for cooling ring 32 while maintaining the appropriate atmosphere for the production of metal casting 22 within furnace 10. The closed loop configuration of ring 32 and source 50 may be used in a vacuum environment, inert gas environment or otherwise.

Furnace 10 thus provides an apparatus and method for controlling the temperature of a metal casting produced by a continuous casting mold so that the surface smoothness and internal metallurgical structure of the metal casting may be more closely controlled to provide a higher quality product. While the invention is useful generally, it is particularly beneficial for use in inert gas or vacuum environments, for which forced air cooling and water spray cooling is inappropriate. It will be appreciated by one skilled in the art that various changes may be made which are within the scope of the present invention. The temperature sensor is typically an infrared sensor although any suitable temperature sensor may be used for the purpose. In addition, the heat source is primarily represented as including an induction coil. However, the figures alternately represent the use of a resistively heated coil powered by the electric power source. Induction coils or resistance heaters may be used in both inert gas and vacuum environments or otherwise. Other heat sources known in the art may be utilized as well. Similarly, the cooling device may be any device which is suitable for the purpose. In addition, an insulating blanket (not shown) may be used to cover the ingot surface to slow down the ingot cooling rate. Insulating blankets may be used in both inert gas and vacuum environments or otherwise.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a continuous casting mold adapted to produce a metal casting;

a metal casting pathway which is disposed below the mold and adapted to allow the metal casting to move therethrough; and a temperature control mechanism comprising a heat source which is disposed adjacent the pathway below the mold; a temperature sensor for sensing temperature at a sensing location entirely after the mold which is disposed on the pathway whereby the temperature sensor is adapted to measure the temperature of the metal casting at the sensing location; and a control unit in communication with the temperature sensor and the heat source, the control unit comprising a logic circuit programmed to control operation of the heat source in response to input from the temperature sensor whereby the heat source is adapted for selectively heating the metal casting as it moves along the pathway below the mold.

2. The apparatus of claim 1 wherein the heat source doubles as a cooling device adapted for selectively cooling the metal casting as it moves along the pathway.

3. The apparatus of claim 2 wherein the heat source includes electrically conductive liquid-cooled conduits.

4. The apparatus of claim 1 wherein the heat source circumscribes the pathway.

5. The apparatus of claim 1 wherein the temperature control mechanism includes a cooling device which is separate from the heat source and is disposed adjacent the pathway below the mold; the control unit is in communication with the cooling device; and the logic circuit is programmed to control operation of the cooling device in response to input from the temperature sensor whereby the cooling device is adapted for selectively cooling the metal casting as it moves along the pathway.

6. The apparatus of claim 5 further comprising a sealed chamber which is one of filled with an inert gas and under vacuum; and wherein the cooling device is disposed within the sealed chamber.

7. The apparatus of claim 1 further including a chamber which is sealed from an external environment and under vacuum; and wherein the heat source is disposed within the chamber and includes at least one of an induction coil and a resistance heating element.

8. The apparatus of claim 1 wherein the temperature control mechanism includes a cooling device which is disposed adjacent the pathway below the mold; the control unit is in communication with the cooling device; and the logic circuit is programmed to control operation of the cooling device in response to input from the temperature sensor whereby the cooling device is adapted for selectively cooling the metal casting as it moves along the pathway.

9. The apparatus of claim 8 wherein the cooling device circumscribes the pathway.

10. The apparatus of claim 8 further including a chamber which is filled with an inert gas and sealed from an external environment; and wherein the mold and cooling device are disposed within the chamber.

11. The apparatus of claim 10 further comprising a source of inert cooling gas in communication with the cooling device; and a cooling gas pathway which is within the chamber and is in communication with each of the cooling device and the metal casting pathway; and wherein the inert cooling gas is movable via the cooling gas pathway from the cooling device to the metal casting pathway whereby the cooling gas is adapted to cool the metal casting as it moves through the metal casting pathway.

12. The apparatus of claim 1 wherein the sensing location is above the heat source.

13. The apparatus of claim 1 further comprising a sealed chamber which is one of filled with an inert gas and under vacuum; and wherein the heat source is disposed within the sealed chamber.

14. A method comprising the steps of:

forming a metal casting with a continuous casting mold;

sensing the temperature of the metal casting with a sensor located entirely after the mold; and controlling a heat source after the mold to control the temperature of the metal casting exiting the mold in response to the step of sensing.

15. The method of claim 14 wherein the step of controlling includes the step of heating the metal casting with the heat source if the temperature is below a predetermined value.

16. The method of claim 15 wherein the step of heating includes the step of heating the metal casting with the heat source wherein the heat source circumscribes the metal casting as it moves away from the mold.

17. The method of claim 15 wherein the step of controlling includes the steps of heating the metal casting with the heat source in response to the step of sensing; and reducing an amount of heat supplied by the heat source which was heating the metal casting to allow the metal casting to cool if the temperature is above a predetermined value.

18. The method of claim 15 wherein the step of controlling includes the step of cooling the metal casting with a cooling device disposed below the mold and adjacent the metal casting if the temperature is above a predetermined value.

19. The method of claim 14 wherein the step of controlling includes the step of cooling the metal casting with a cooling device disposed below the mold and adjacent the metal casting if the temperature is above a predetermined value.

20. The method of claim 19 wherein the step of cooling includes the step of cooling the metal casting with the cooling device wherein the cooling device circumscribes the metal casting as it moves away from the mold.

21. The method of claim 19 wherein the step of forming includes the step of forming a metal casting with a continuous casting mold disposed within an inert-gas-filled chamber; and wherein the step of cooling includes the step of moving a cooled inert gas out of the cooling device into the chamber toward the metal casting.

22. The method of claim 14 wherein the step of sensing comprises the step of sensing the temperature of the metal casting at a sensing location above the heat source.

23. The method of claim 14 further comprising, prior to the step of controlling, the steps of:

positioning the heat source within a sealed chamber; and one of (a) filling the sealed chamber with an inert gas and (b) placing the sealed chamber under vacuum; and wherein the step of controlling comprises the step of controlling the heat source to operate within the sealed chamber.

24. The method of claim 23 further comprising, prior to the step of controlling, the steps of:

positioning a cooling device below the mold within the sealed chamber; and wherein the step of controlling comprises the step of controlling the cooling device in response to the step of sensing to operate within the sealed chamber.

* * * * *